US011945026B1

(12) United States Patent
Shan et al.

(10) Patent No.: US 11,945,026 B1
(45) Date of Patent: Apr. 2, 2024

(54) MULTI-PATH INTERNAL MICROPOROUS EFFICIENT REFRIGERATION METHOD AND DEVICE FOR FROZEN SAND MOLD

(71) Applicant: NANJING UNIVERSITY OF AERONAUTICS AND ASTRONAUTICS, Nanjing (CN)

(72) Inventors: Zhongde Shan, Nanjing (CN); Haoqin Yang, Nanjing (CN); Jianpei Shi, Nanjing (CN)

(73) Assignee: NANJING UNIVERSITY OF AERONAUTICS AND ASTRONAUTICS, Nanjing (CN)

( * ) Notice: Subject to any disclaimer, the term of this patent is extended or adjusted under 35 U.S.C. 154(b) by 0 days.

(21) Appl. No.: 18/523,890

(22) Filed: Nov. 30, 2023

Related U.S. Application Data

(63) Continuation of application No. PCT/CN2023/074059, filed on Feb. 1, 2023.

(30) Foreign Application Priority Data

Nov. 4, 2022 (CN) ..... 202211377138.4

(51) Int. Cl.
*B22C 9/12* (2006.01)
*B22C 9/02* (2006.01)

(52) U.S. Cl.
CPC ..... *B22C 9/126* (2013.01); *B22C 9/02* (2013.01)

(58) Field of Classification Search
CPC ..... B22C 9/02; B22C 9/126
See application file for complete search history.

(56) References Cited

FOREIGN PATENT DOCUMENTS

| | | | | |
|---|---|---|---|---|
| CN | 112077262 | A | | 12/2020 |
| CN | 112872294 | A | | 6/2021 |
| CN | 114535498 | A | | 5/2022 |
| CN | 114558990 | A | | 5/2022 |
| CN | 114799057 | A | | 7/2022 |
| CN | 114850449 | A | | 8/2022 |
| CN | 114888265 | A | | 8/2022 |
| CN | 115625290 | A | | 1/2023 |
| JP | 56006754 | A | * | 1/1981 |
| JP | 2004058116 | A | * | 2/2004 |
| JP | 2009066640 | A | | 4/2009 |
| JP | 2012040569 | A | | 3/2012 |

* cited by examiner

*Primary Examiner* — Kevin E Yoon
(74) *Attorney, Agent, or Firm* — Bayramoglu Law Offices LLC

(57) ABSTRACT

A multi-path internal microporous efficient refrigeration method and device for a frozen sand mold is provided. The device includes a frozen sand molding chamber, an electric lifting platform, a teflon porous lining, a removable porous aluminum plate, a frozen sand mold refrigeration device box, a sealing cover plate, an ultrasonic piezoelectric sheet, a U-shaped condenser tube, an ultrasonic generator, and a low-temperature refrigeration system. The teflon lining and the removable porous aluminum plate are provided with through hole structures of the same size and shape for rapid cooling from the surface to core of molding sand. The lifting platform is opened and the bumpy-ridge teflon lining rises to a highest point to facilitate demolding. The high- and low-frequency dual mode of the ultrasonic piezoelectric sheet can be used for vibrating and compacting the frozen sand mold, and can also assist in cutting forming.

6 Claims, 4 Drawing Sheets

MULTI-PATH INTERNAL MICROPOROUS EFFICIENT REFRIGERATION METHOD AND DEVICE FOR FROZEN SAND MOLD

CROSS REFERENCE TO THE RELATED APPLICATIONS

This application is a continuation application of International Application No. PCT/CN2023/074059, filed on Feb. 1, 2023, which is based upon and claims priority to Chinese Patent Application No. 202211377138.4, filed on Nov. 4, 2022, the entire contents of which are incorporated herein by reference.

TECHNICAL FIELD

The present invention belongs to the field of green casting in frozen sand molds, and in particular, to a multi-path internal microporous efficient refrigeration method and device for a frozen sand mold.

BACKGROUND

The conventional casting industry consumes a lot of resources and relies on a wood/metal mold to produce a sand mold for casting. Sand casting faces problems of long manufacturing cycle, many production processes, high labor intensity, expensive product development, harsh working environment, and the like. The conventional casting industry urgently needs breakthroughs and reforms in green processes to promote energy conservation, emission reduction, and green sustainable development in the manufacturing industry. Green casting processes and equipment can reduce material and energy waste in the casting process, reduce waste discharge, decrease the scrap rate of castings, improve the yield of castings, achieve efficient, high-quality and accurate forming of castings, and achieve green casting production.

A digital green casting forming technology for a frozen sand mold uses water as a binder to achieve sand bonding and digital cutting/printing of the sand mold under low temperature conditions, which can manufacture high-quality castings. The principle is to use a printing nozzle/milling cutter to directly implement material additive/subtractive manufacturing of a frozen sand mold (core) under the drive of a three-dimensional CAD model for a sand mold, so as to obtain a to-be-poured sand mold after surface treatment and assembly. Whether the strength and hardness of a prepared frozen sand billet satisfy digital and efficient cutting before the frozen sand mold is cut is crucial. The strength and hardness of the frozen sand billet depend on water content, freezing temperature, the number of sand grains, and the like. Under the conditions of existing equipment, large-sized frozen sand billets face problems of long freezing time, high cost, difficult demolding, and the like. It is urgent to develop new methods and devices to achieve rapid freezing, convenient demolding, and low-cost forming of frozen sand molds.

SUMMARY

To solve the above problems, the present invention discloses a multi-path internal microporous efficient refrigeration method and device for a frozen sand mold. The device mainly solves problems of low freezing efficiency, low compactness, difficult demolding, and the like in a premixed green sand billet production process.

A multi-path internal microporous efficient refrigeration device for a frozen sand mold, comprising a frozen sand molding chamber, an electric lifting platform, a frozen sand mold refrigeration device box, an ultrasonic generator, and a low-temperature refrigeration system, wherein the frozen sand molding chamber is located inside the frozen sand mold refrigeration device box and a bottom of the frozen sand molding chamber is arranged on the electric lifting platform; the frozen sand molding chamber includes a teflon porous lining and a removable porous aluminum plate; and the ultrasonic piezoelectric sheet is located between the teflon porous lining and the removable porous aluminum plate and fixed at a bottom of the teflon porous lining.

The removable porous aluminum plate is located on an outer side of the teflon porous lining; and the ultrasonic piezoelectric sheet is connected to the ultrasonic generator outside the frozen sand mold refrigeration device box through a wire.

The low-temperature refrigeration system comprises a U-shaped condenser tube, a liquid nitrogen tank, a nitrogen tank, a flow meter, one-way valves, and a low-temperature gas mixing chamber; the U-shaped condenser tube is located inside the frozen sand mold refrigeration device box; the liquid nitrogen tank is connected to the low-temperature gas mixing chamber through a first pipeline; a one-way valve is arranged on the first pipeline; the nitrogen tank is connected to the low-temperature gas mixing chamber through a second pipeline; the flow meter and a one-way valve are sequentially arranged on the second pipeline; the low-temperature gas mixing chamber is connected to the U-shaped condenser tube through a pressure regulating valve and a low-temperature pipeline sequentially; and external low-temperature gas is connected to the U-shaped condenser tube through a low-temperature resistant pipeline to achieve rapid refrigeration of the frozen sand molding chamber 1.

The teflon porous lining and the removable porous aluminum plate are provided with through holes of the same size and positions, and are assembled to ensure that cold gas enters the interior of the frozen sand mold via the through holes; the teflon porous lining is formed by splicing four teflon molds, and junctions of the teflon molds are designed in a similar "n" shape; and after a core of the frozen sand mold reaches a preset temperature, the lifting platform is started to facilitate demolding of the frozen sand mold, and the frozen sand mold can be placed on a digital forming machine for milling after being taken out.

A multi-path internal microporous efficient refrigeration method for a frozen sand mold, the method being suitable for rapid freezing and auxiliary cutting processes of the frozen sand mold (quartz sand, zircon sand, chrome iron ore sand, etc), and specific implementation steps comprising:

S1, selecting suitable molding sand according to characteristics of a casting, and measuring 3%-8% of water by weight into a sand mixer, followed by uniform mixing for 2 to 10 minutes to prepare water-containing green sand;

S2, starting the electric lifting platform to ensure that the frozen sand molding chamber is located at an upper limit position; laying the prepared green sand grains in the frozen sand molding chamber, starting the ultrasonic generator and selecting a low frequency to vibrate and compact a sand mold; inserting iron wires along the through holes of the teflon porous lining to form vent holes following an arrangement law on a frozen sand billet; starting the electric lifting platform again to ensure that the frozen sand molding chamber is located at a lower limit position;

S3, starting the low-temperature refrigeration system, mixing low-temperature gas with nitrogen through the one-way valve to form a low-temperature mixed gas, delivering the low-temperature mixed gas to a condenser tube loop through a pressure regulating valve for cyclic refrigeration, enabling the through holes of the teflon porous lining and the removable porous aluminum plate to quickly enter a core of the sand mold, and freezing the frozen sand billet; and S4, when the internal temperature of the frozen sand mold reaches a preset temperature, opening a sealing cover plate, selecting to open the electric lifting platform, and taking out the frozen sand mold; or placing the entire frozen sand molding device on a platform of a digital forming machine for digital cutting forming to ensure that the strength and hardness of the frozen sand mold satisfy efficient cutting forming; after the core of the frozen sand mold reaches the preset temperature, starting the lifting platform to facilitate demolding of the frozen sand mold, and placing the frozen sand mold on the digital forming machine for milling after being taken out.

Furthermore, the through holes on the teflon porous lining and the removable porous aluminum plate are designed according to fluent flow field simulation to form a "square", "hexagonal lattice", "star", or "circle" shape, so as to accelerate convective heat transfer of low-temperature gas and improve the refrigeration efficiency of the sand mold.

Furthermore, the sealing cover plate is arranged above the frozen sand mold refrigeration device box and the frozen sand molding chamber for thermal insulation; and a film is attached to an inner wall of the sealing cover plate, and the film is one of an ethyl vinyl acetate (EVA) plastic film, a low density polyethylene film (LDPE) or polyester amine fibers for moisturizing the frozen sand mold.

Furthermore, the ultrasonic generator has a low-frequency mode and a high-frequency mode; in the high-frequency mode, the ultrasonic piezoelectric sheet transmits vibration for compaction in the frozen sand molding process to prevent internal defects in the frozen sand mold; and in the low-frequency mode, the entire frozen sand mold is placed on the digital forming machine to achieve an ultrasonic milling function for the frozen sand mold.

Furthermore, when the low-temperature refrigeration system operates, the liquid nitrogen tank is first opened to exhaust air inside the pipeline, the temperature of the space inside the pipeline decreases after a period of time, and liquid nitrogen is delivered into the pipeline in a liquid form; next, the nitrogen tank is opened, the nitrogen flow meter is adjusted, nitrogen is enabled to enter the gas-liquid mixing chamber and mixed with the liquid nitrogen, the nitrogen exchanges heat with the liquid nitrogen by means of low-temperature characteristics of the liquid nitrogen, and low-temperature nitrogen is ultimately formed and delivered to the condenser tube inside the device through the thermal insulation pipeline to cool the frozen sand mold.

The liquid nitrogen tank is filled with either compressed low-temperature air or low-temperature $CO_2$ gas, wherein different low-temperature gases have different temperature ranges, resulting in higher refrigeration efficiency for sand molds with different thermal conductivities.

Beneficial effects of the present invention are as follows:

(1) This solution achieves the purpose of rapid refrigeration of a frozen sand mold by forming internal vent holes and an external low-temperature refrigeration system to freeze pre-mixed green sand at a low temperature, thereby saving energy consumption and improving economic efficiency.

(2) The ultrasonic piezoelectric sheet can not only vibrate and compact the sand mold in the molding process, but also assist in ultrasonic cutting in the digital forming process, thereby effectively reducing cutting temperature, improving machining quality, and prolonging service life of a tool head to reduce some costs.

BRIEF DESCRIPTION OF THE DRAWINGS

In FIG. 1, 1—frozen sand molding chamber, 2—electric lifting platform, 3—teflon lining, 4—removable porous aluminum plate, 5—frozen sand mold refrigeration device box, 6—sealing cover plate, 7—ultrasonic piezoelectric sheet, 8—U-shaped condenser tube, 9—ultrasonic generator, 10—low-temperature refrigeration system.

In FIG. 4, 11—liquid nitrogen tank, 12—nitrogen tank, 13—flow meter, 14—one-way valve, 15—low-temperature gas mixing chamber.

DETAILED DESCRIPTION OF THE EMBODIMENTS

Figure 1:
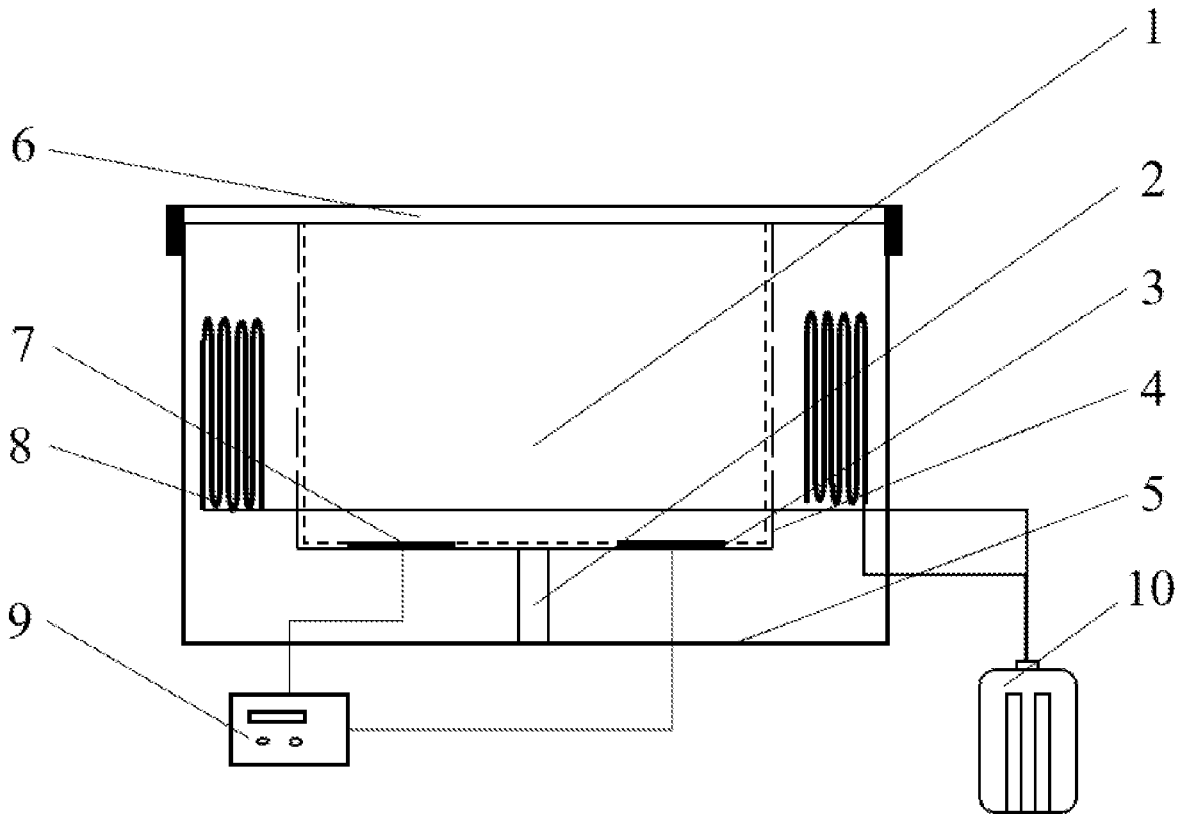
FIG. 1 is a schematic diagram of a multi-path internal microporous efficient refrigeration device for a frozen sand mold.

The present invention is further illustrated below in conjunction with the drawings and specific implementation manners, and it should be understood that the following specific implementation manners are merely used for describing the present invention and not to limit the scope of the present invention. It needs to be noted that, the words "front", "back", "left", "right", "upper", and "lower" used in the following description refer to directions in the drawings, and the words "inside" and "outside" respectively refer to directions toward or away from the geometric center of a particular component.

As shown in FIG. 1, a multi-path internal microporous efficient refrigeration device for a frozen sand mold, comprising a frozen sand molding chamber 1, an electric lifting platform 2, a frozen sand mold refrigeration device box 5, an ultrasonic generator 9, and a low-temperature refrigeration system 10, wherein the frozen sand molding chamber 1 is located insided the frozen sand mold refrigeration device box 5 and a bottom of the frozen sand molding chamber 1 is arranged on the electric lifting platform 2; the frozen sand molding chamber 1 includes a teflon porous lining 3 and a removable porous aluminum plate 4; and the ultrasonic piezoelectric sheet 7 is located between the teflon porous lining 3 and the removable porous aluminum plate 4 and fixed at a bottom of the teflon porous lining 3.

The removable porous aluminum plate 4 is located on an outer side of the teflon porous lining 3; and the ultrasonic piezoelectric sheet 7 is connected to the ultrasonic generator 9 outside the frozen sand mold refrigeration device box 5 through a wire.

The low-temperature refrigeration system 10 comprises a U-shaped condenser tube 8, a liquid nitrogen tank 11, a nitrogen tank 12, a flow meter 13, one-way valves 14, and a low-temperature gas mixing chamber 15; the U-shaped condenser tube 8 is located inside the frozen sand mold refrigeration device box 5; the liquid nitrogen tank 11 is connected to the low-temperature gas mixing chamber 15 through a first pipeline; a one-way valve 14 is arranged on the first pipeline; the nitrogen tank 12 is connected to the low-temperature gas mixing chamber 15 through a second pipeline; the flow meter 13 and a one-way valve 14 are sequentially arranged on the second pipeline; the low-temperature gas mixing chamber 15 is connected to the U-shaped condenser tube 8 through a pressure regulating valve and a low-temperature pipeline sequentially.

The teflon porous lining 3 and the removable porous aluminum plate 4 are provided with through holes of the same size and positions, and are assembled to ensure that cold gas enters the interior of the frozen sand mold via the through holes.

Figure 2:
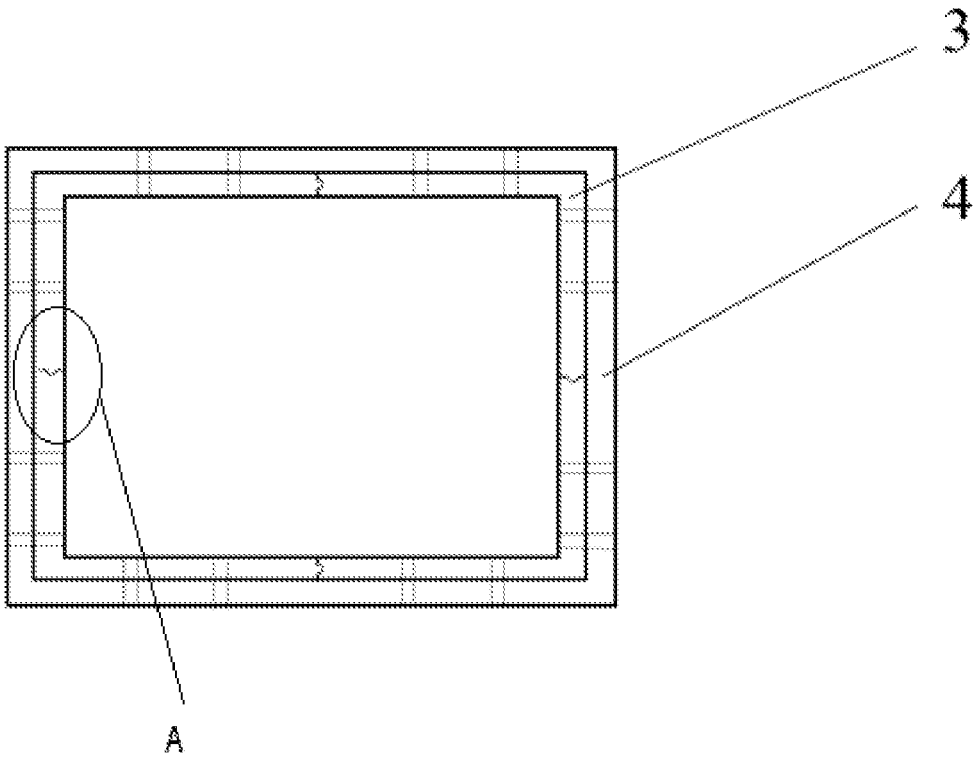
FIG. 2 is a schematic structural diagram of a teflon lining of the present invention.
Figure 3A:
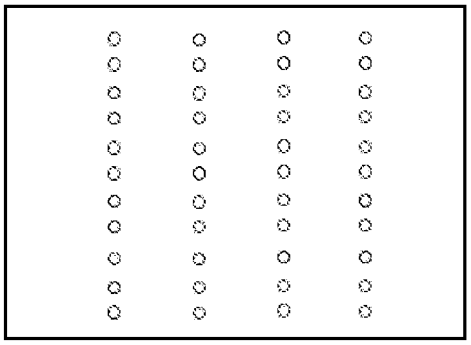
FIGS. 3A-3D are schematic structural diagrams of vent holes of the present invention, where the vent holes are arranged in a square in FIG. 3A, a hexagonal lattice in FIG. 3B, a star shape in FIG. 3C, and a circular shape in FIG. 3D.
Figure 3B:
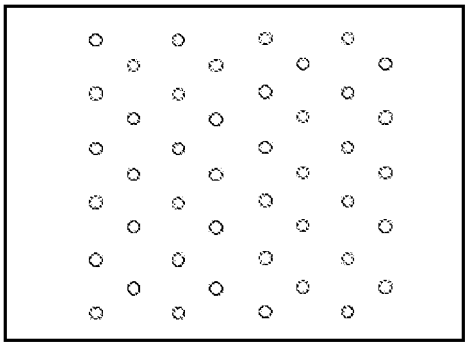
Figure 3C:
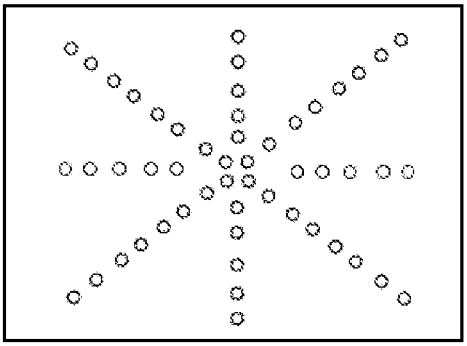
Figure 3D:
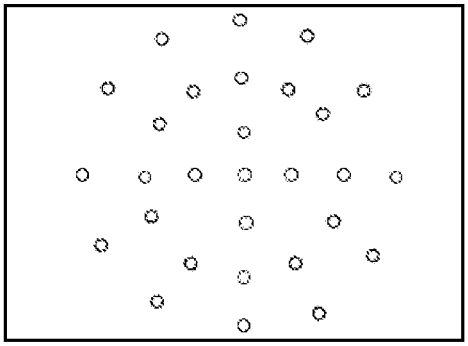
Figure 4:
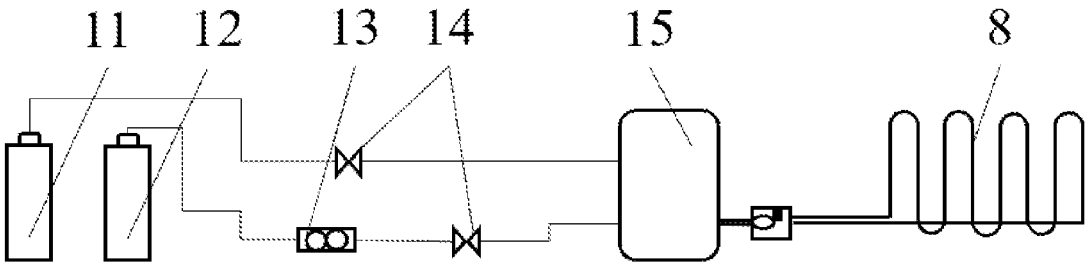
FIG. 4 is a schematic structural diagram of a low-temperature refrigeration system of the present invention.
Figure 5:
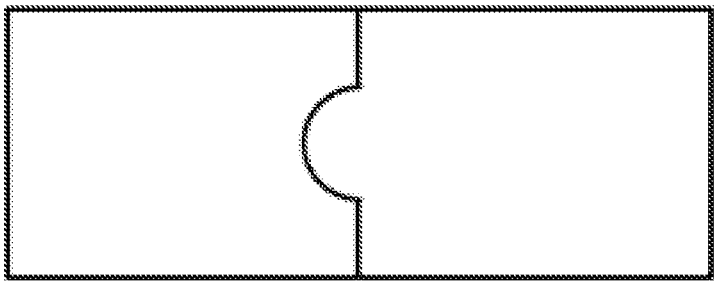
FIG. 5 is a partial enlarged view of A in FIG. 2.

As shown in FIG. 2 and FIG. 5, the teflon porous lining 3 is formed by splicing four teflon molds, and junctions of the teflon molds are designed in a similar "n" shape.

A multi-path internal microporous efficient refrigeration method for a frozen sand mold, the method being suitable for rapid freezing and auxiliary cutting processes of the frozen sand mold, and specific implementation steps comprising:

S1, selecting suitable molding sand according to characteristics of a casting, and measuring 3%-8% of water by weight into a sand mixer, followed by uniform mixing for 2 to 10 minutes to prepare water-containing green sand;

S2, starting the electric lifting platform to ensure that the frozen sand molding chamber is located at an upper limit position; laying the prepared green sand grains in the frozen sand molding chamber, starting the ultrasonic generator and selecting a low frequency to vibrate and compact a sand mold; the ultrasonic generator has a low-frequency mode and a high-frequency mode; in the high-frequency mode, the ultrasonic piezoelectric sheet transmits vibration for compaction in the frozen sand molding process to prevent internal defects in the frozen sand mold; and in the low-frequency mode, the entire frozen sand mold is placed on the digital forming machine to achieve an ultrasonic milling function for the frozen sand mold;

Inserting iron wires along the through holes of the teflon porous lining to form vent holes following an arrangement law on a frozen sand billet; starting the electric lifting platform again to ensure that the frozen sand molding chamber is located at a lower limit position;

S3, starting the low-temperature refrigeration system, mixing low-temperature gas with nitrogen through the one-way valve to form a low-temperature mixed gas, delivering the low-temperature mixed gas to a condenser tube loop through a pressure regulating valve for cyclic refrigeration, enabling the through holes of the teflon porous lining and the removable porous aluminum plate to quickly enter a core of the sand mold, and freezing the frozen sand billet; and When the low-temperature refrigeration system operates, the liquid nitrogen tank is first opened to exhaust air inside the pipeline, the temperature of the space inside the pipeline decreases after a period of time, and liquid nitrogen is delivered into the pipeline in a liquid form; next, the nitrogen tank is opened, the nitrogen flow meter is adjusted, nitrogen is enabled to enter the gas-liquid mixing chamber and mixed with the liquid nitrogen, the nitrogen exchanges heat with the liquid nitrogen by means of low-temperature characteristics of the liquid nitrogen, and low-temperature nitrogen is ultimately formed and delivered to the condenser tube inside the device through the thermal insulation pipeline to cool the frozen sand mold.

The liquid nitrogen tank is filled with either compressed low-temperature air or low-temperature $CO_2$ gas, wherein different low-temperature gases have different temperature ranges, resulting in higher refrigeration efficiency for sand molds with different thermal conductivities.

S4, when the internal temperature of the frozen sand mold reaches a preset temperature, opening a sealing cover plate, selecting to open the electric lifting platform, and taking out the frozen sand mold; or placing the entire frozen sand molding device on a platform of a digital forming machine for digital cutting forming to ensure that the strength and hardness of the frozen sand mold satisfy efficient cutting forming; after the core of the frozen sand mold reaches the preset temperature, starting the lifting platform to facilitate demolding of the frozen sand mold, and placing the frozen sand mold on the digital forming machine for milling after being taken out.

As shown in FIGS. 3A-3D, the through holes on the teflon porous lining and the removable porous aluminum plate are designed according to fluent flow field simulation to form a "square", "hexagonal lattice", "star", or "circle" shape, so as to accelerate convective heat transfer of low-temperature gas and improve the refrigeration efficiency of the sand mold.

The sealing cover plate 6 is arranged above the frozen sand mold refrigeration device box 5 and the frozen sand molding chamber for thermal insulation; and a film is attached to an inner wall of the sealing cover plate, and the film is one of an ethyl vinyl acetate (EVA) plastic film, a low density polyethylene film (LDPE) or polyester amine fibers for moisturizing the frozen sand mold.

The technical means disclosed by the solution of the present invention are not merely limited to the technical means disclosed in the above implementation manners, but also include technical solutions composed of any combination of the above technical features.

What is claimed is:

1. A multi-path internal microporous efficient refrigeration method for a frozen sand mold, implemented by a multi-path internal microporous efficient refrigeration device, wherein the multi-path internal microporous efficient refrigeration device comprises a frozen sand molding chamber, an electric lifting platform, a frozen sand mold refrigeration device box, an ultrasonic generator, and a low-temperature refrigeration system, wherein the frozen sand molding chamber is located inside the frozen sand mold refrigeration device box and a bottom of the frozen sand molding chamber is arranged on the electric lifting platform; the frozen sand molding chamber comprises a polytetrafluoroethylene (PTFE) porous lining and a removable porous aluminum plate; and an ultrasonic piezoelectric sheet is located between the PTFE porous lining and the removable porous aluminum plate and fixed at a bottom of the PTFE porous lining;

wherein the method is suitable for rapid freezing and auxiliary cutting processes of the frozen sand mold, and specific implementation steps comprises:

S1, selecting suitable molding sand according to characteristics of a casting, and measuring 3%-8% of water by weight into a sand mixer, followed by uniform mixing for 2 to 10 minutes to prepare water-containing green sand;

S2, starting the electric lifting platform to ensure that the frozen sand molding chamber is located at an upper limit position; laying prepared green sand grains in the frozen sand molding chamber, starting the ultrasonic generator and selecting a low frequency to vibrate and compact a sand mold; inserting iron wires along through holes of the PTFE porous lining to form vent holes following an arrangement law on a frozen sand billet; starting the electric lifting platform again to ensure that the frozen sand molding chamber is located at a lower limit position;

S3, starting the low-temperature refrigeration system, mixing low-temperature gas with nitrogen through a one-way valve to form a low-temperature mixed gas, delivering the low-temperature mixed gas to a condenser tube loop through a pressure regulating valve for cyclic refrigeration, enabling the through holes of the PTFE porous lining and the removable porous aluminum plate to quickly enter a core of the sand mold, and freezing the frozen sand billet; and S4, when an internal temperature of the frozen sand mold reaches a preset temperature, opening a sealing cover plate, selecting to open the electric lifting platform, and taking out the frozen sand mold; or placing an entire frozen sand molding device on a platform of a digital forming machine for digital cutting forming to ensure that strength and hardness of the frozen sand mold satisfy efficient cutting forming; after the core of the frozen sand mold reaches the preset temperature, starting the lifting platform to facilitate demolding of the frozen sand mold, and placing the frozen sand mold on the digital forming machine for milling after being taken out.

2. The multi-path internal microporous efficient refrigeration method for the frozen sand mold according to claim 1, wherein the through holes on the PTFE porous lining and the removable porous aluminum plate are designed according to fluent flow field simulation to form a "square", "hexagonal lattice", "star", or "circle" shape, so as to accelerate convective heat transfer of the low-temperature gas and improve refrigeration efficiency of the sand mold.

3. The multi-path internal microporous efficient refrigeration method for the frozen sand mold according to claim 1, wherein the sealing cover plate is arranged above the frozen sand mold refrigeration device box and the frozen sand molding chamber for thermal insulation; and a film is attached to an inner wall of the sealing cover plate, and the film is one of an ethyl vinyl acetate (EVA) plastic film, a low density polyethylene film (LDPE) or polyester amine fibers for moisturizing the frozen sand mold.

4. The multi-path internal microporous efficient refrigeration method for the frozen sand mold according to claim 1, wherein the ultrasonic generator has a low-frequency mode and a high-frequency mode; in the high-frequency mode, the ultrasonic piezoelectric sheet transmits vibration for compaction in a frozen sand molding process to prevent internal defects in the frozen sand mold; and in the low-frequency mode, the entire frozen sand mold is placed on the digital forming machine to achieve an ultrasonic milling function for the frozen sand mold.

5. The multi-path internal microporous efficient refrigeration method for the frozen sand mold according to claim 1, wherein when the low-temperature refrigeration system operates, a liquid nitrogen tank is first opened to exhaust air inside a pipeline, a temperature of a space inside the pipeline decreases after a period of time, and liquid nitrogen is delivered into the pipeline in a liquid form; next, a nitrogen tank is opened, a nitrogen flow meter is adjusted, nitrogen is enabled to enter a gas-liquid mixing chamber and mixed with the liquid nitrogen, the nitrogen exchanges heat with the liquid nitrogen by low-temperature characteristics of the liquid nitrogen, and low-temperature nitrogen is ultimately formed and delivered to a condenser tube inside the multi-path internal microporous efficient refrigeration device through a thermal insulation pipeline to cool the frozen sand mold.

6. The multi-path internal microporous efficient refrigeration method for the frozen sand mold according to claim 5, wherein the liquid nitrogen tank is filled with either compressed low-temperature air or low-temperature $CO_2$ gas, wherein different low-temperature gases have different temperature ranges, resulting in higher refrigeration efficiency for sand molds with different thermal conductivities.

* * * * *